United States Patent [19]

Herrera Giammattei et al.

[11] Patent Number: 4,572,068

[45] Date of Patent: Feb. 25, 1986

[54] DECORATING SYSTEM FOR CERAMIC FLATWARE

[75] Inventors: Octavio Herrera Giammattei, Monterrey; Federico Veramontes Brown, Garza Garcia; Benedo Beltran Leyva, Mexicali; Damian Cervantes Patiño, Monterrey, all of Mexico

[73] Assignee: Vitro Tec Fideicomiso, Monterrey, Mexico

[21] Appl. No.: 681,007

[22] Filed: Dec. 13, 1984

[30] Foreign Application Priority Data

Dec. 15, 1983 [MX] Mexico ..... 199772

[51] Int. Cl.[4] ..... B41F 17/00

[52] U.S. Cl. ..... 101/35; 101/126

[58] Field of Search ..... 101/123, 115, 124, 126, 101/35

[56] References Cited

U.S. PATENT DOCUMENTS

| | | | |
|---|---|---|---|
| 2,124,011 | 7/1938 | Smith | 101/123 |
| 2,529,250 | 11/1950 | Fordyce | 101/123 |
| 2,569,049 | 9/1951 | Gordon | 101/123 |
| 2,605,700 | 8/1952 | Martin | 101/123 |
| 3,172,357 | 3/1965 | Rudolph et al. | 101/126 |

*Primary Examiner*—Clifford D. Crowder

*Attorney, Agent, or Firm*—Abelman Frayne Rezac & Schwab

[57] ABSTRACT

A device for decorating ceramic flatware includes color applicators rotatable about a common axis for simultaneously decorating a central portion and a rim portion of the flatware.

3 Claims, 3 Drawing Figures

DECORATING SYSTEM FOR CERAMIC FLATWARE

FIELD OF THE INVENTION

This invention relates to machines for decorating ceramic flatware, such as plates and the like, by means of the serigraph process.

BACKGROUND OF THE INVENTION

In the decorating of ceramic flatware, the ware is sequentially passed through a feeding station, a centering station, and a decorating station. Various techniques are used for the decorating of plates, such as serigraphy, decalcomania and other like processes.

An apparatus using the serigraph process is disclosed in U.S. Pat. No. 3,054,345 of J. K. Martin. That apparatus includes a screen or stencil, and a base supporting a plate to be decorated. The base elevates until the screen contacts the plate and conforms to the shape of the plate. A squeegee or similar applicator then rotates around the screen to provide contact of the screen with the plate, and in order to print the decoration on the plate.

This apparatus effects a single print on the plate (either on the center or on the rim of the same). In order to decorate both parts of the ware, i.e., the center and the rim, the plate must pass through a first station for printing of the center and thereafter pass through a second station for printing of the rim. This makes the process rather slow and hampers production speed.

In an attempt to increase production, and provide for simultaneous printing of the center and rim, a printing plate was prepared with the decoration in bas relief, and a paint applicator was passed over the printing plate to fill the figures with paint. A doctor blade or similar element was then employed for removing the excess paint from the printing plate, leaving just the paint within the decorations. A silicone transfer pad was then employed to pick up the paint within the decorations and then to transfer the paint to the wares to be painted.

This type of printing produces a gradual loss of elasticity of the silicone transfer pad resulting in deformations of the pad and a loss of fidelity in the printing.

Further, as the transfer pad must move between one station where it picks up the paint, and to another station where it effects the printing, this results in a reduction in production speed to to the required translation movement. Additionally, the machine is complex and costly.

SUMMARY OF THE INVENTION

It is a principal object of the present invention to provide a device for decorating ceramic flatware or similar articles by the serigraph process, which can simultaneously decorate both the center and rim of wares in a single operation.

It is a further object of the present invention to provide a device for decorating ceramic flatware or similar articles, by means of which the decoration is effected at one single station, thus permitting a high speed of production.

A further object of the present invention is to provide a device for decorating ceramic flatware or similar articles, which permits easy and rapid inspection and maintenance of the device, and which permits the printing of any type of decoration in an optimum and consistant manner.

According to the present invention, the decoration of ceramic flatware is effected simultaneously on the center and rim thereof in a single operation, by the utilization of a device having two squeegees or similar applicators which rotate simultaneously, one squeegee acting to decorate the rim of the article and the other acting to decorating the center of the article, thus allowing the production speed to be doubled.

Further, as the decoration of the ware's center and rim is carried out in simultaneous manner and without movement of either decorating element or the ware between different stations, a further increase in the production speed is obtained.

Further, two colors may be simultaneously used for decorating at the same station, thus constituting a great advantage over the known systems.

BRIEF DESCRIPTION OF THE DRAWINGS

A preferred embodiment of the invention will now be described with reference to the accompanying drawings, in which.

DESCRIPTION OF THE PREFERRED EMBODIMENT

The device of the present invention consists, essentially, of three main components, namely: a support 10 for holding the ware to be decorated; a decorating mechanism MD of the squeegee or similar type, and which includes a screen P; and, a drive unit.

Figure 1:
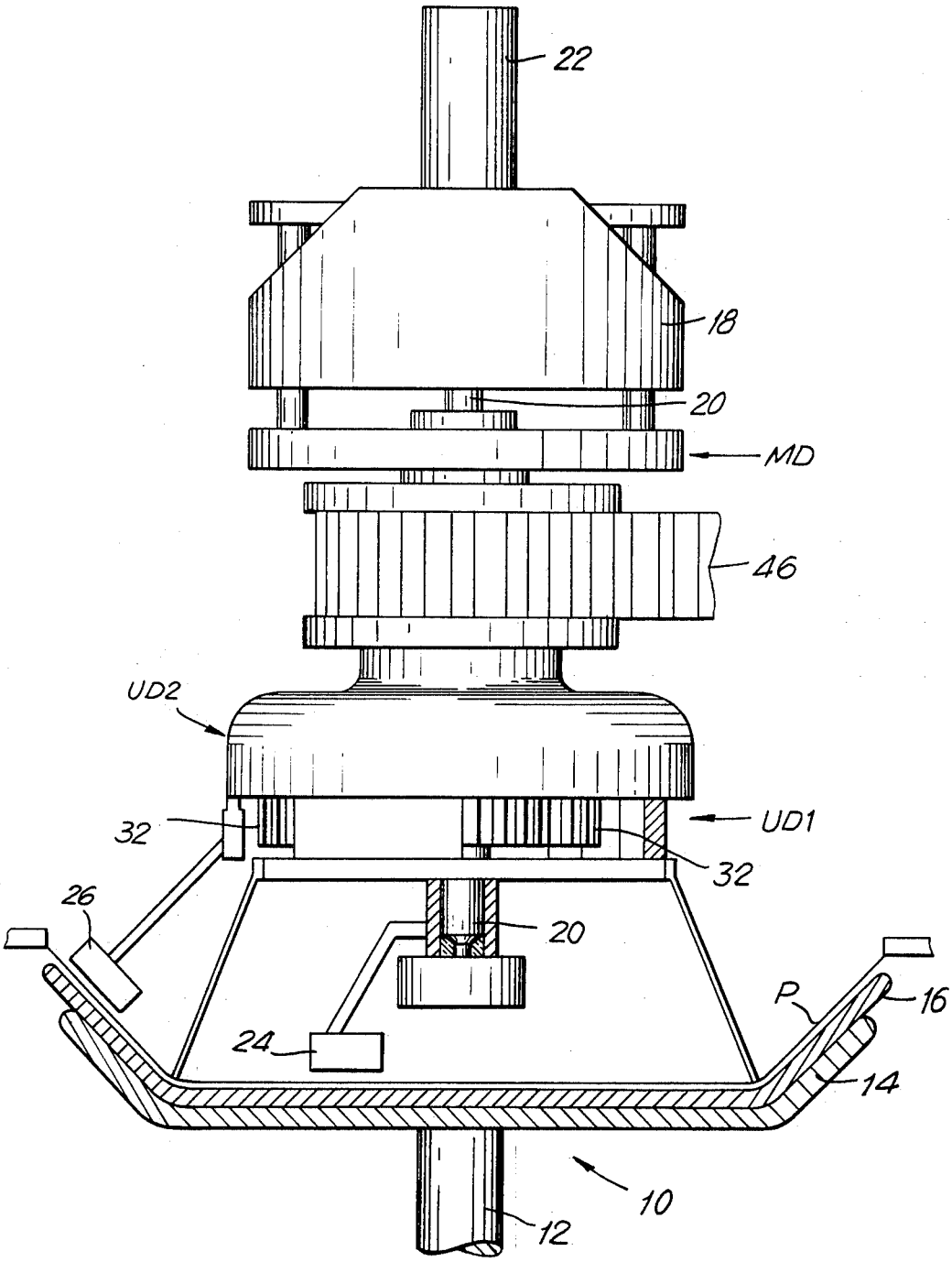
FIG. 1 is a front elevation view of the decorating device of the present invention.

As shown in FIG. 1, the support 10, includes an vertical shaft 12 on which a platten 14 is mounted. The ware 16 supported on the platten 14 and held by gravity or by vacuum. The feeding of wares onto the platten 14 may be effected manually by an operator, or automatically by an appropriate mechanism (not shown).

After the ware 16 has been positioned on the platten 14, the decorating mechanism MD then moves downward into contact with the surface of ware 16. By means of screen P squeegee 24 and 26, it then prints the decoration onto the ware 16. When the decoration is completed, the decorating mechanism MD then moves upwards to its original position. The decorated ware is then manually or automatically removed from the platten and replaced by a succeeding article.

The decorating mechanism MD includes a fixed support 18, for a central axially moveable shaft 20 which is moved under the control of a pneumatic piston 22. A first decorating unit UD1 supported concentrically to the shaft 20, includes a squeegee or similar element 24, which forces paint to pass through the screen or stencil P (FIG. 1), to decorate the central part of the ware. A second decorating unit UD2, is supported concentrically on first decorating unit UD1, and includes a second squeegee 26, which forces paint to pass through screen P, to decorate the rim part of ware 16.

Figure 3:
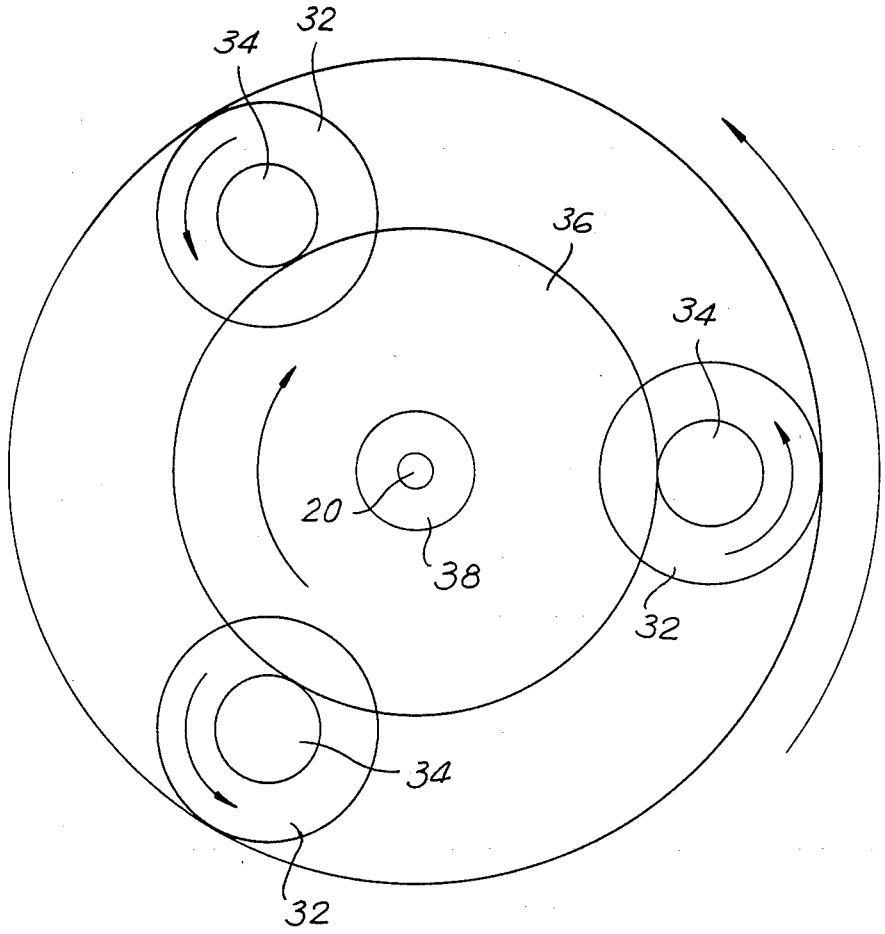
FIG. 3 is a diagramatic plan view, taken on line A—A' of FIG. 2.

The first decorating unit UD1 includes a fixed hollow shaft portion 28 supported on the central shaft 20 and which carries an annular frame 30. Journalled in the frame are planetary gears 32, distributed equidistantly from each other, as shown in FIG. 3. Each of the gears 32, carries a drive gear 34 of smaller diameter, which rotate in unison with the gears 32. A central gear 36 is engaged with the gears 34 and has a plined central bore within which is received an externally splined shaft 38. The splined shaft 38 is freely rotatable on the lower end of the central shaft 20, thus causes upward telescoping movement of the splined shaft 38 into the central gear 36, and upward movement of the squeegee 24.

The second decorating unit UD2 includes a header 40, rotatable on the shaft 28 and which carries a flange 42 supporting a ring gear 44. The ring gear 44 drives the gears 32 and 34 and in turn reversely drives the central gear 36. The header 40 carries the second squeegee 26 and is driven by an electric motor (not shown) through a drive chain 46.

Figure 2:
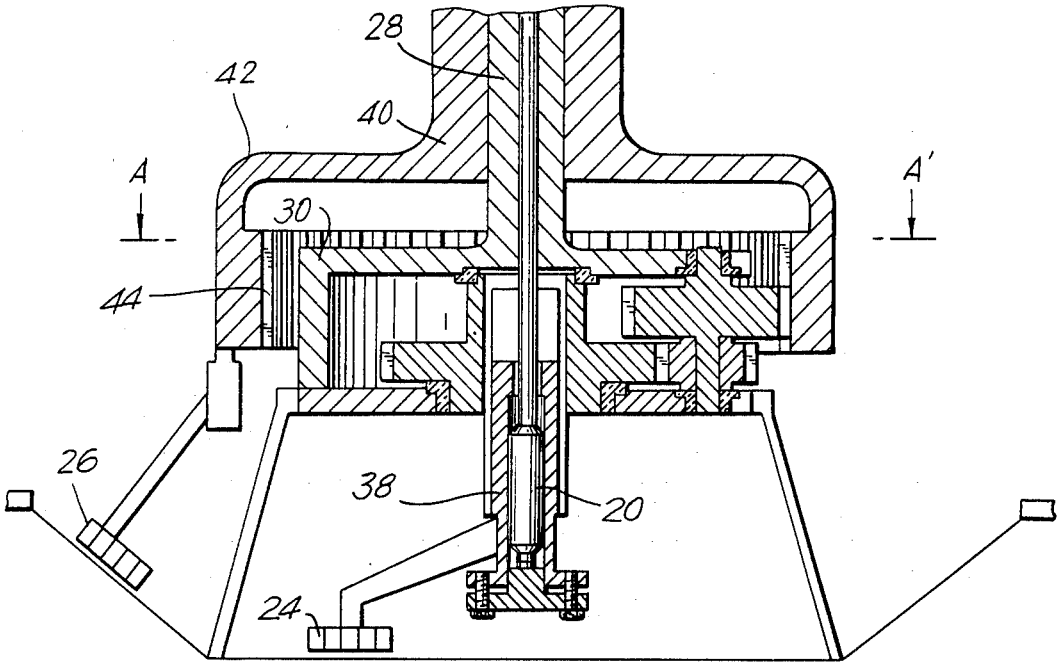
FIG. 2 is a cross section of the lower end of the decorating device.

As will be understood, the decorating device of FIGS. 1, 2 and 3, in operative to simultaneously decorate the center and the rim of the ware by means of the squeegee or similar elements which gyrate and rotate about the central shaft 20 oppositely to each other.

It will be understood that the invention is not specifically limited to the preferred embodiment described above, and th various changes as to the design and lay out of the components may be made without departing from the scope of the appended claims.

We claim:

1. A device for decorating ceramic flatware, comprising:

an axially moveable but rotationally fixed shaft;

a carrier for planetary gears supported on said rotationally fixed shaft;

planetary gears journalled in said carrier;

a central gear journalled within said carrier and meshed with said respective planetary gears;

said central gear carrying a first applicator for coloring material;

a header rotatable on said rotationally fixed shaft and carrying a second applicator for coloring material;

a ring gear carried by said header and meshed with said respective planetary gears; and, drive means for rotating said header whereby rotational movement of said header produces rotational movement of said planetary gears and of said central gear, thus enabling both of said applicators of coloring material to be driven on separate circular paths.

2. The device according to claim 1, in which said central gear is tubular and internally splined,. and a splined shaft is axially slidable within said central gear and carries said first applicator of coloring material, further including an axially moveable central shaft for moving said splined shaft and said first applicator towards said rotationally fixed shaft, and for then moving said rotationally fixed shaft axially to move said header and said second applicator away from a printing screen of said device.

3. The device of claim 1, in which said planetary gears each include dual gears, one meshed with said ring gear and the other meshed with said central gear, rotation of said respective pairs of meshed gears providing drives of substantially equal ratio.

* * * * *

UNITED STATES PATENT AND TRADEMARK OFFICE

CERTIFICATE OF CORRECTION

PATENT NO. : 4,572,068

DATED : February 25, 1986

INVENTOR(S) : GIAMMATTEI, et al.

It is certified that error appears in the above-identified patent and that said Letters Patent is hereby corrected as shown below:

Front page, column 1

Under [75], amend spelling of second inventor to read

--Federico Viramontes Brown--

Signed and Sealed this

*Twelfth* Day of *August 1986*

[SEAL]

*Attest:*

DONALD J. QUIGG

*Attesting Officer*

*Commissioner of Patents and Trademarks*